US008210446B1

(12) United States Patent
Oliviera

(10) Patent No.: US 8,210,446 B1
(45) Date of Patent: Jul. 3, 2012

(54) HYGIENICALLY PRESENTED SIP STRAW BY A BARTENDER

(76) Inventor: Alberto Oliviera, Mineola, NY (US)

( * ) Notice: Subject to any disclaimer, the term of this patent is extended or adjusted under 35 U.S.C. 154(b) by 0 days.

(21) Appl. No.: 12/583,025

(22) Filed: Aug. 14, 2009

(51) Int. Cl.
*B05B 17/04* (2006.01)

(52) U.S. Cl. ..... 239/12; 239/33; 239/288; 239/289; 53/148; 53/236

(58) Field of Classification Search ..... 239/1, 12, 239/24, 33, 288, 289; 206/446; 53/450, 53/148, 236, 550, 412, 492; 215/388; 229/103.1; 604/77, 78, 257; 220/705–710
See application file for complete search history.

(56) References Cited

U.S. PATENT DOCUMENTS

| | | | | |
|---|---|---|---|---|
| 5,054,264 | A * | 10/1991 | Miller | 53/412 |
| 5,722,219 | A * | 3/1998 | Dobransky | 229/103.1 |
| 5,823,422 | A * | 10/1998 | Collier et al. | 229/103.1 |
| 6,223,505 | B1 * | 5/2001 | Meetze et al. | 53/450 |
| 6,227,403 | B1 * | 5/2001 | Kim | 215/388 |
| 7,314,183 | B2 * | 1/2008 | Zuccaro | 239/33 |

* cited by examiner

*Primary Examiner* — Steven J Ganey
(74) *Attorney, Agent, or Firm* — Galgano & Associates, PLLC; Thomas M. Galgano; Jessica G. Bower

(57) ABSTRACT

A beverage sipping straw 14 maintained in a hygienic condition using a cover 34 removed by a bar patron 12 exposing a surface untainted the bartender's 10 handling of the presentation to the patron 12.

1 Claim, 1 Drawing Sheet

HYGIENICALLY PRESENTED SIP STRAW BY A BARTENDER

The present invention relates generally to maintaining a hygienic condition in the sipping end of a beverage straw handed to a patron of a bar by a bartender, and more particularly, to the achievement of this objective using a sanitary paper or plastic cover of the straw sipping end removed by the patron, all as will be better understood as the description proceeds.

BACKGROUND OF THE INVENTION

In the course of bartending, a bartender handles money, glasses and the like, and removes from a container of plural straws a selected one which is presented to a patron. For his/her convenience in making the selection, the top of the straw is gripped for presentation to the patron and commonly a pair of sanitary gloves is not worn by the bartender and, even if worn, is not discarded after the handling of money and other germ-infecting activity, thus creating an unsanitary condition.

SUMMARY OF THE INVENTION

Broadly, it is an object of the present invention to overcome the foregoing and other shortcomings of the prior art.

More particularly, it is an object to apply a paper or plastic sanitary cover over the sipping straw end, thereby actually obviating even the need for use of sanitary gloves by the bartender leaving it to the patron to remove the cover preparatory by sipping use of the sipping straw. The outside of the cover is understood not to be sanitary, but the removal thereof results in a sanitary condition in the straw exposed beneath the cover.

BRIEF DESCRIPTION OF SEVERAL VIEWS OF THE DRAWING

The description of the invention which follows, together with the accompanying drawing should not be construed as limiting the invention to the example shown and described, because those skilled in the art to which this invention appertains will be able to devise other forms thereof.

DETAILED DESCRIPTION OF THE INVENTION

Figure 1:
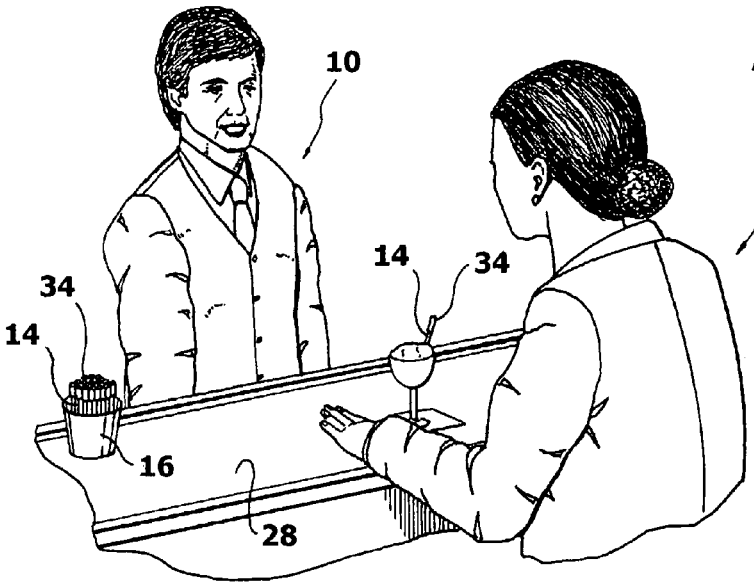
FIG. 1 is a perspective view of a bartender making a hygienic presentation of a sip straw to a patron in accordance with the present invention.
Figure 2:
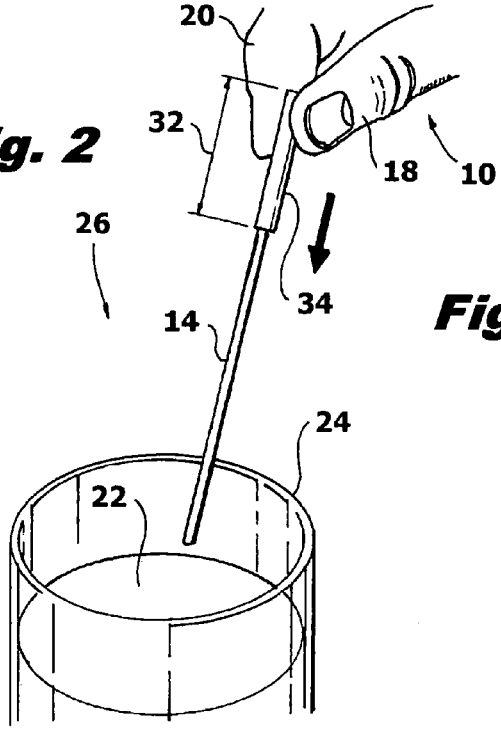
FIG. 2 is also a perspective view, in actual scale, of the sip straw in a hygienic condition as presented by the bartender.

Although it is known from common experience that food handlers are required to use disposable gloves to minimize the transmission of viruses and the like, inadvertently overlooked in being held to a similar sanitary standard is a bartender, generally designated 10, in a work environment of FIG. 1 serving the needs of patrons 12 with a sip straw 14 as generally noted in FIG. 2, taken from a sip straw container 16.

As is currently the practice, the sip straw 14 is gripped between the bartender's thumb 18 and pointing finger 20 and deposited in a beverage 22 of a drinking glass 24, as noted at 26. And even assuming the precaution of the bartender 10 using a disposable glove (not shown), as required of a food handler, this precaution is inadequate because the handing of money, wiping clean the bar surface 28 and attending to such chores, taints the bartender's fingers, even if gloved, and the consequences is a possible and most probable virus transmission.

To overcome the foregoing and other shortcomings of the noted prior practice, the upper drinking end 30 of the sip straw 14 is disposed with a length 32 of a sanitary cover 34 of paper construction material, and it is such cover that is finger-gripped in the presentation of the sip straw to the patron.

Figure 3:
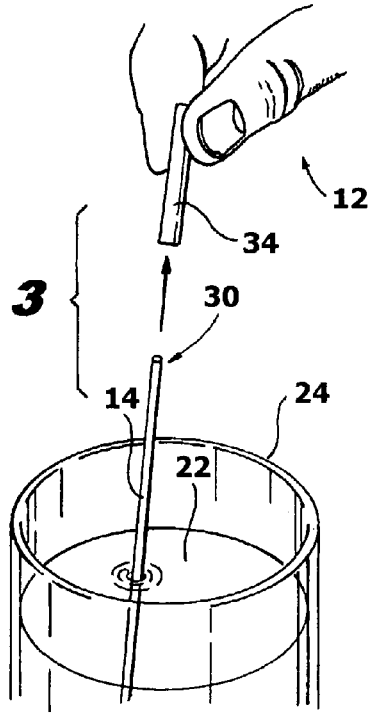
FIG. 3 is a perspective view of the presented sip straw in place preparatory to use.

When in place, as noted in FIG. 3, the patron 12 removes the cover 34 and consumes the beverage 22 through the sip straw drinking end 30, which is in a hygienic condition, untainted by the bartender.

In a preferred embodiment the length of the sipping straw is at least five inches, the construction material of the cover could also be plastic as well as paper.

What is claimed is:

1. A method at a bar site of use of presenting a hygienically constituted straw by a bartender to a patron for use thereat, said method comprising the steps of:

A. providing a container having an open top end with a plurality of straws disposed therein, each of said straws having a selected length terminating at opposite first and second ends and wherein at least a portion of said straws is uncovered;

B. providing a plurality of hollow sleeves each having at least one open end which is removably receivable over said first ends of said straws, said sleeves having a length which is less than said length of said straws, wherein each of said straws has a sleeve removably received over said first end thereof and wherein said second end of each of said straws is uncovered;

C. arranging said plurality of straws having said sleeves received over said first ends thereof in said container, with said second ends of said straws disposed within said container and said first ends of said straws with said sleeves received thereon accessible via said open top end of said container;

D. selecting one of said plurality of straws having said sleeves received thereon from said container by grasping at least one of said sleeves received over said first ends of said straws; and E. placing said uncovered second end of said straw into a beverage while holding said sleeve received over said first end of said straw;

whereby removal of said sleeve in covering relation on said straw first end by said patron makes accessible a hygienically constituted straw end.

* * * * *

UNITED STATES PATENT AND TRADEMARK OFFICE

CERTIFICATE OF CORRECTION

PATENT NO. : 8,210,446 B1
APPLICATION NO. : 12/583025
DATED : July 3, 2012
INVENTOR(S) : Alberto Oliveira It is certified that error appears in the above-identified patent and that said Letters Patent is hereby corrected as shown below:

On the title page, correct the Inventor's name as follows:

(12) United States Patent

"Oliviera" -- Oliveira --

(76) Inventor: Alberto "Oliviera" -- Oliveira --, Mineola, NY (US)

Signed and Sealed this
Sixteenth Day of October, 2012

David J. Kappos

David J. Kappos
*Director of the United States Patent and Trademark Office*